United States Patent [19]

Barbieri et al.

[11] Patent Number: 4,917,250

[45] Date of Patent: Apr. 17, 1990

[54] FOLDING SHELF FURNITURE UNIT

[76] Inventors: Raul Barbieri; Giorgio Marianelli, both of Via Faruffini, 13, 20149 Milan, Italy

[21] Appl. No.: 211,371

[22] Filed: Jun. 24, 1988

[30] Foreign Application Priority Data

Jul. 16, 1987 [IT] Italy ..... 21234 A/87

[51] Int. Cl.[4] ..... A47F 5/00

[52] U.S. Cl. ..... 211/149; 211/195

[58] Field of Search ..... 211/149, 195; 108/115; 182/159, 1

[56] References Cited

U.S. PATENT DOCUMENTS

| | | | |
|---|---|---|---|
| 1,106,418 | 8/1914 | Sprunger | 211/149 X |
| 1,198,431 | 9/1916 | Forsyth | 211/149 X |
| 1,909,223 | 5/1933 | Roos | 211/149 X |
| 1,929,768 | 10/1933 | Bixby | 211/149 X |
| 1,955,769 | 4/1934 | Reynolds | 211/149 X |
| 2,466,462 | 4/1949 | Miller, Jr. | 211/149 X |
| 2,584,489 | 2/1952 | Morrison | 211/149 |

*Primary Examiner*—J. Franklin Foss
*Assistant Examiner*—Sarah A. Lechok
*Attorney, Agent, or Firm*—Steinberg & Raskin

[57] ABSTRACT

A shelf furniture unit, comprising trestle sides with their front legs and rear legs upperly hinged, at least some of the shelves being rotatably supported by the front legs and by bars forming with said shelves an articulated parallelogram structure, with at least one of the shelves arranged to cooperate with the rear legs in order to modify the inclination of the shelves and to enable the legs to be closed together.

13 Claims, 2 Drawing Sheets

FOLDING SHELF FURNITURE UNIT

SUMMARY OF THE INVENTION

This invention relates to a shelf furniture unit which can be folded by a simple procedure without the use of any tool, to assume a small overall size facilitating both its transportation and storage, and which again by a simple procedure is adjustable in terms of the inclination of at least some of its shelves and the horizontal position of certain of its shelves.

According to the invention, the shelf furniture unit is characterized essentially by comprising trestle sides with their front legs and rear legs upperly hinged, at least some of the shelves being rotatably supported by the front legs and by bars forming with said shelves an articulated parallelogram structure, with at least one of the shelves there being associated means arranged to cooperate with counter-means associated with the rear legs in order to modify the inclination of the shelves and to enable the legs to be closed together.

BRIEF DESCRIPTION OF THE DRAWINGS

The invention will be more apparent from the detailed description of a preferred embodiment thereof given hereinafter by way of non-limiting example and illustrated on the accompanying drawing in which.

DESCRIPTION OF THE PREFERRED EMBODIMENTS

Figure 1:
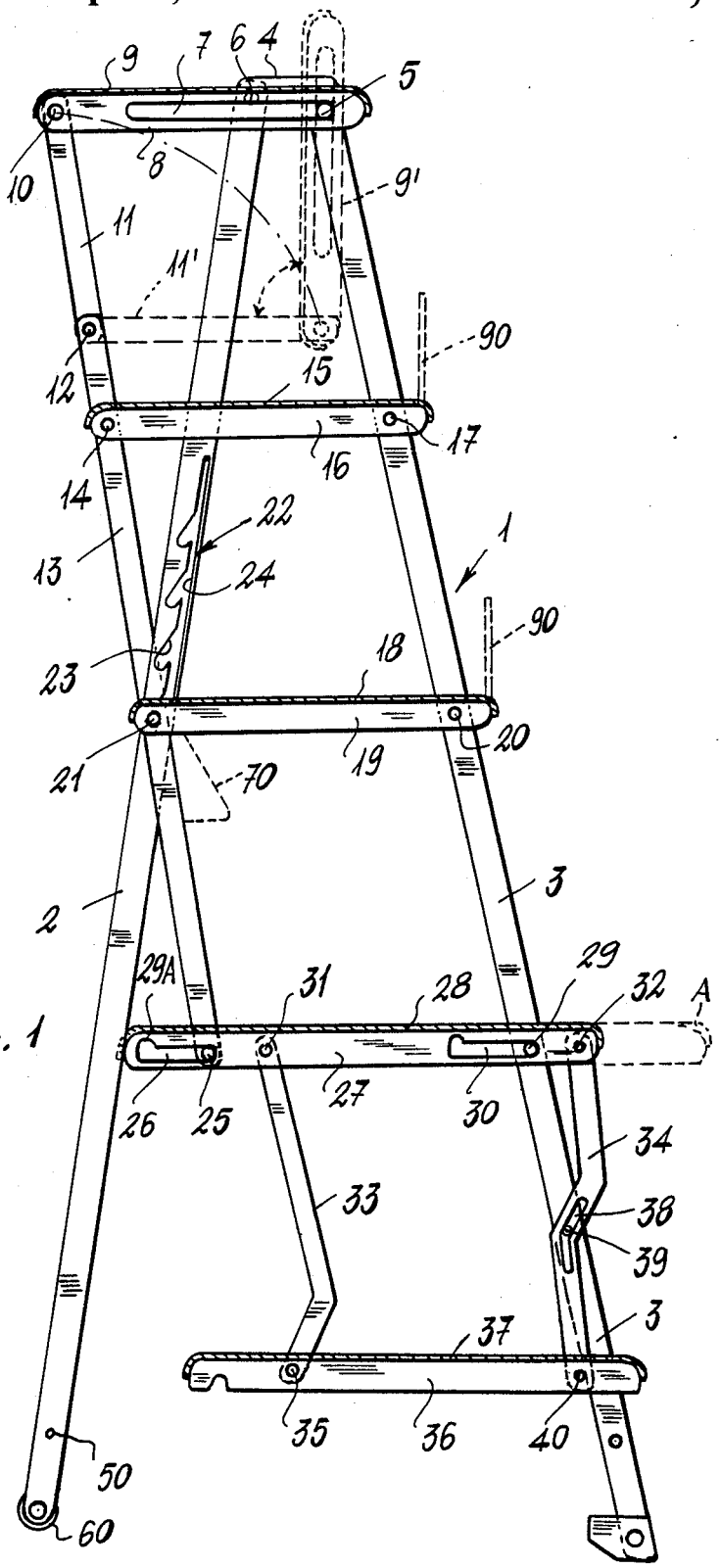
FIG. 1 is a diagrammatic vertical section through the centre of the unit according to the invention when in a position of use.
Figure 2:
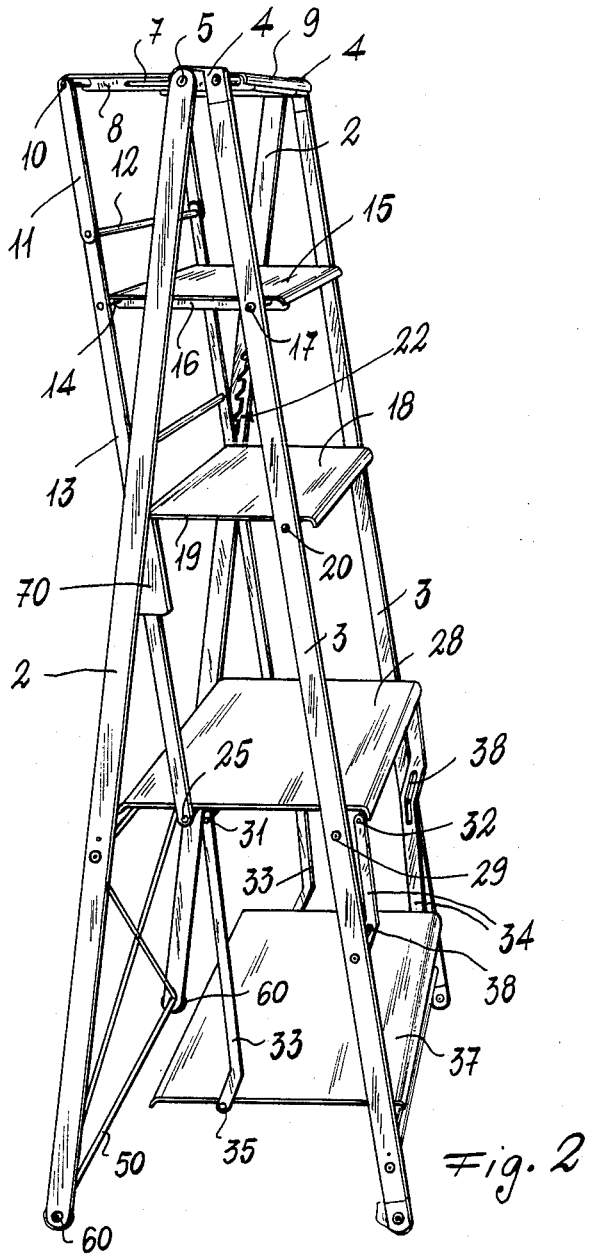
FIG. 2 is a perspective view of the unit in the position shown in FIG. 1.

With reference to the drawing, the unit according to the invention comprises two sides each formed from a trestle 1. Each trestle comprises a rear leg 2 and a front leg 3. These latter are bent upperly at an angle at 4, the rear legs 2 being hinged to the end of this angularly bent part at 6.

At the level of the angularly bent part 4 the two front legs 3 of the two trestles 1 are joined together by a transverse element 5 fixed to them at its ends. The rod shaped element 5 passes through elongated slots 7 provided in two spaced-apart members 8 fixed to the lower face of a top shelf, which is indicated by 9 and is interposed between the two trestles 1. The slots 7 are straight and parallel to the shelf 9 except at their end where they are shaped to form a seat (when in the position of use shown in the figure) for the transverse element 5.

The top shelf 9 is hinged on a transverse element 10 which traverses suitable holes provided in the two members 8 and is rigid at its ends with a pair of bars 11 which in their turn are lowerly hinged on a traverse element 12 which joins them together and on which there is also hinged a pair of bars 13. By virtue of the described construction it is possible to make the parts 9 and 11 assume the positions shown by dashed lines and indicated by 9'' and 11''. For this purpose it is necessary only to move the shelf 9 so that its slot 7 slides along the element 5, and at a certain point during this sliding movement rotate the shelf upwards about the element itself.

The parts 9 and 11 then fall by gravity to assume the indicated positions 9'' and 11''.

On the inside of the bars 11 there are hinged on the ends of the transverse element 12 two further bars 13 which support at one of their ends a further shelf 15 lying below the preceding by means a transverse element 14.

Specifically, the transverse element 14 passes through holes provided in a pair of members 16 fixed spaced apart to the lower face of the shelf in question.

The two members 16 are also traversed at their front end by a transverse element 17 extending between and fixed to the front legs 3 of the two trestles 1.

A further shelf 18 is provided below the preceding and is likewise provided with a pair of members 19 identical to the described members 16 and through the holes (front and rear) of which there extend two transverse elements 20, 21. The element 20 is supported by the front legs 3 of the two trestles while the element 21 is supported by the members 19 and projected at its two ends to penetrate into shaped slots or guides 22 provided in the rear legs 2 of the two trestles.

The slots 22 are substantially of saw-tooth shape on one face 23 and flat on the opposite face 24. Such a slot shape enables the various shelves to assume various inclinations.

The lower ends of the bars 13 are joined together by a transverse element 25 which passes through shaped slots 26 provided in a pair of members 27 which are fixed spaced apart to the lower face of a fourth shelf 28 which can act either as an actual shelf or as a writing surface if moved forwardly, i.e. into the position shown by dashed lines and indicated by the letter A.

The slot 26 extends parallel to the shelf and is straight along a certain portion, this being followed by a seat 29A for supporting the rod element 25 when the shelf 28 is moved into the position A. The shelf 28 is also supported on a front transverse element 29 which is supported by the front legs 3 of the trestles and traverses a slot 30 in a member 27 identical to the member 26. The shelf 28 supports a pair of transverse elements 31, 32 projecting from the sides of said shelf. Bars 33, 34 are pivoted on the projecting parts. The bars 33 are bent at an angle at their lower ends and are joined together by a transverse element 35 which passes trough suitable holes provided in two members 36 fixed to the lower face of the lowest shelf 37.

The bars 34 are Z-shaped and at their elbow there is provided a V-shaped slot 38 into which there penetrates a pin 39 projecting inwards from the front legs 3 of the trestles 1. At their lower ends the bars 34 are joined together by a transverse element 40 which passes through suitable holes provided in the two members 36 of the lowest shelf 37. By virtue of the described linkages, moving the shelf 28 in the direction A causes the underlying shelf 37 to move in the opposite direction, i.e. retract. This is necessary to prevent a person on using the shelf 28 as a writing surface hitting his legs against the shelf 37. Moreover these linkages enable the two shelves 28, 37 to incline together with the others.

To adjust the shelves from the horizontal position of FIG. 1 to an inclined position, the user stands behind the unit and places a foot on a cross-member 50 which joins the rear legs 2 of the trestles 1 together. He then lifts the shelf 18 and at the same time, with his foot, he pulls the rear legs 2 towards himself by means of the said cross-member 50. By this means he disengages the transverse element 21 from the saw-tooth on the side 23 and moves it to the required height and into the corresponding saw-tooth. By way of the bars 11 and 13, this movement is converted into a rotation of all the shelves through a predetermined angle. In order to fold up the unit, i.e. to close the rear legs 2 against the front legs 3 of the trestles but in such a manner that the shelves remain within the outline of the folded trestles, it is necessary only to firstly rotate the upper shelf 9 as indicated by the dashed lines and then carry out the aforesaid procedure to move the rod element 21 into the top of the guides 22.

The bars 11, 13, the shelves 9, 16, 18, 28 and the front legs 3 form an articulated parallelogram structure.

Advantageously, wheels 60 are provided to facilitate the maneuvers at the base of the rear legs.

Furthermore, in order to avoid any danger to the user, metal plates 70 are fixed to the rear legs 2 at the level of the shelf 18.

In order to prevent supported objects sliding and falling when the shelves are inclined, removable front plates 90 can be fixed to the front of the shelves in any suitable manner.

What we claim is:

1. A furniture shelf unit, comprising front legs and rear legs upperly hinged together, a plurality of shelves rotatably supported upon said front legs, bars additionally supporting said plurality of shelves, with said front legs, bars, and plurality of shelves together forming an articulated parallelogram structure, and means for coupling at least one of said plurality of shelves with said rear legs and comprising, means associated with said at least one shelf and counter-means associated with said rear legs, and both said shelf and said counter-means arranged to cooperate with one another, for modifying attitude or inclination of said plurality of shelves and spacing said front and rear legs closer together or further apart from one another.

2. The combination of claim 1, wherein said bars each comprise two parts hinged together.

3. The combination of claim 1, additionally comprising a top shelf of said plurality of shelves being provided with substantially straight guides, and means for supporting said top shelf upon said front legs and arranged to cooperate with said guides of said top shelf, with said top shelf being rotatably mounted about said supporting means on said front legs.

4. The combination of claim 1, additionally comprising a shelf having substantially straight guides therein, means for supporting said shelf upon said front legs and arranged to cooperate with said guides, an underlying shelf arranged underneath said shelf provided with said guides, pairs of bars arranged to join said underlying shelf with said overlying shelf, one bar of each said pair being provided with means for movably mounting the same upon said front legs, and counter-means being associated with said front legs for cooperating with said mounting means of said respective bars, with said underlying and overlying shelves thus being mounted with respect to one another, such that when one of said shelves is moved in a particular direction, said other shelf is moved in an opposite direction.

5. The combination of claim 3, wherein said substantially straight guides each comprise a seat at one end thereof for containing said supporting means of said front legs.

6. The combination of claim 4, wherein said substantially straight guides each comprise a seat at one end thereof for containing said supporting means of said front legs.

7. The combination of claim 1, wherein said counter-means comprise a substantially saw-toothed guide provided on said rear legs for supporting said shelf at a rear thereof.

8. The combination of claim 1, wherein an uppermost shelf forms part of said articulated parallelogram structure.

9. The combination of claim 4, wherein said overlying and underlying shelves form lowest shelves in said articulated parallelogram structure.

10. The combination of claim 8, wherein an uppermost one of said respective pair of bars is hinged to said uppermost shelf, such that said uppermost shelf can be collapsed forwardly towards said front legs, with said upper bar arranged in substantially level position.

11. The combination of claim 7, wherein said counter-means comprise slots situated on said respective rear legs with said substantially saw-toothed guide provided on one face of a respective slot, and an opposite face of said respective slot being flat, thus enabling said various shelves to assume various inclination.

12. The combination of claim 9, wherein said bar provided with said mounting means is substantially Z-shaped, with said means being constituted by a substantially V-shaped slot, and said counter-means constituted by a pin mounted on a respective front leg, and lower ones of said bars forming said articulated parallelogram structure with said shelves being movably mounted in rear guide slots provided in said overlying shelf for the same.

13. The combination of claim 1, comprising two pairs of bars, with upper ones of said bars each being hingedly mounted on an uppermost shelf, and lower ones of said bars being hingedly mounted on at least one lower shelf.

* * * * *